US005615608A

United States Patent [19]

Shaw et al.

[11] Patent Number: 5,615,608

[45] Date of Patent: Apr. 1, 1997

[54] REINFORCED CONTAINMENT PALLET

[76] Inventors: Mark D. Shaw, 9820 Preston Trail, Ponte Vedra Beach, Fla. 32082; J. Tad Heyman, 11858 Olde Oaks Ct. N., Jacksonville, Fla. 32223; Laurence M. Bierce, 105 Sandra Rd., Jacksonville, Fla. 32211; Jesse Ehredt, 1711 Duffton La., Painesville, Ohio 44077

[21] Appl. No.: 669,833

[22] Filed: Jun. 26, 1996

Related U.S. Application Data

[63] Continuation of Ser. No. 391,144, Feb. 21, 1995, abandoned.

[51] Int. Cl.[6] ..... B65D 19/44

[52] U.S. Cl. ..... 108/55.3; 108/51.1

[58] Field of Search ..... 108/51.1, 55.3, 108/901, 55.1, 56.3; 248/346.02; 206/386, 595

[56] References Cited

U.S. PATENT DOCUMENTS

| | | | |
|---|---|---|---|
| 3,526,195 | 9/1970 | Maryonovich | 108/901 X |
| 4,930,632 | 6/1990 | Eckert et al. | 108/901 X |
| 5,036,976 | 8/1991 | Sechler et al. | 108/51.1 X |
| 5,042,396 | 8/1991 | Shuert | 108/51.1 |
| 5,092,251 | 3/1992 | Hamaker et al. | 108/51.1 |
| 5,147,039 | 9/1992 | Sechler et al. | 108/51.1 X |
| 5,249,699 | 10/1993 | Williams | 108/51.1 X |
| 5,307,931 | 5/1994 | Gillispie et al. | 108/51.1 X |

FOREIGN PATENT DOCUMENTS

| | | | |
|---|---|---|---|
| 1277133 | 9/1968 | Germany | 108/55.3 |

*Primary Examiner*—Jose V. Chen
*Attorney, Agent, or Firm*—Thomas C. Saitta

[57] ABSTRACT

A containment pallet for supporting large capacity drums is disclosed, the pallet having a large volume sump area to retain liquid. Cross members are provided which join the upper portions of opposing side walls without interfering with the sump area, the cross members restraining the side walls from the tendency to bend outward due to the weight of the drums.

13 Claims, 1 Drawing Sheet

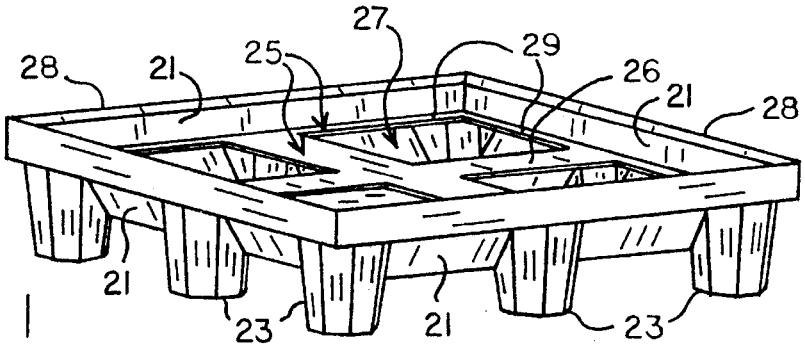
FIG 1
FIG 2
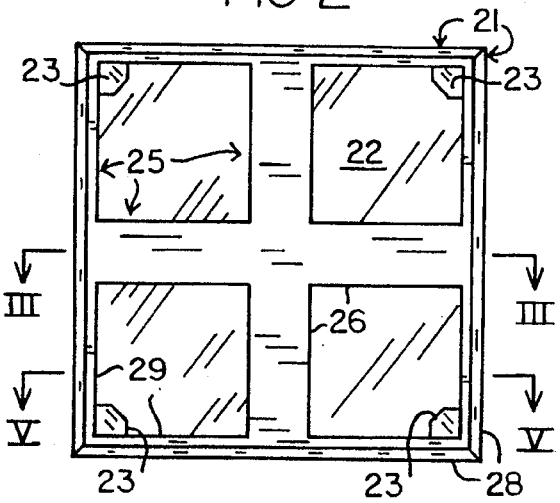
FIG 4
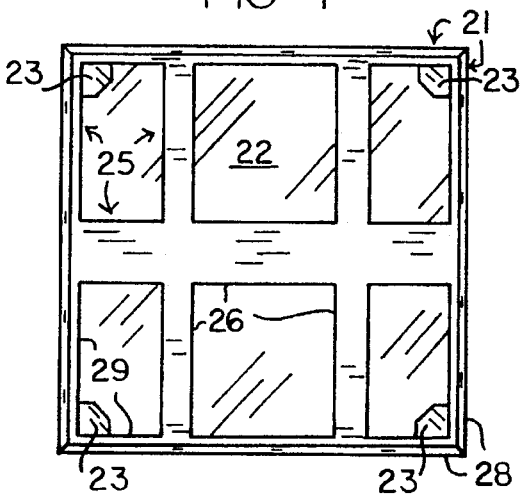
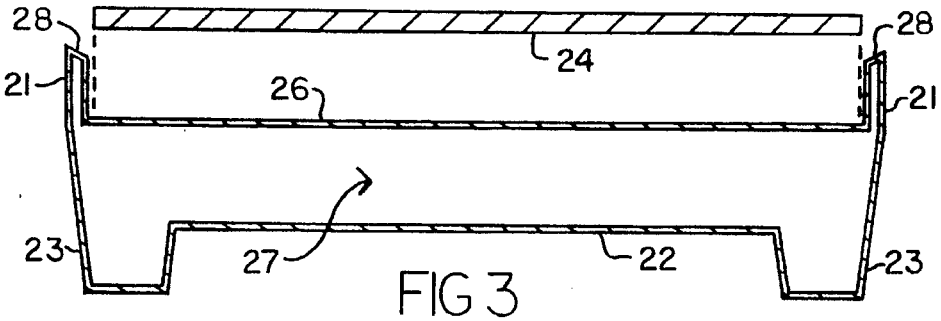
FIG 3
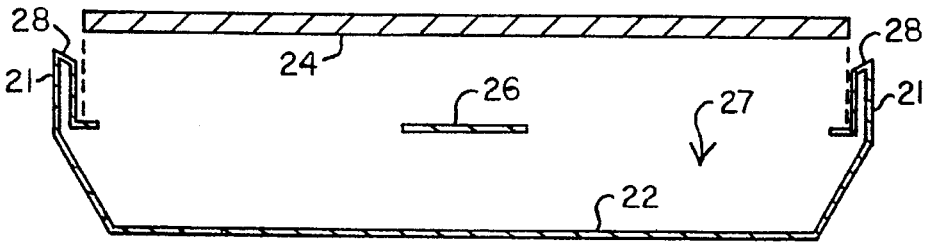
FIG 5

REINFORCED CONTAINMENT PALLET

This application is a continuation of application Ser. No. 08/391,144, filed Feb. 21, 1995, now abandoned.

BACKGROUND OF THE INVENTION

The invention relates generally to the field of pallets used to support large volume objects such as drums or barrels, and more particularly to such pallets which are designed to contain liquid spills in a large sump area formed by the combination of four generally vertical walls and a bottom. Even more particularly, the invention relates to such containment pallets having a deck mounted on a peripheral support shoulder extending from the walls above the sump area for support of the drums, where the walls are reinforced by cross members extending above the sump area.

Hazardous liquid materials are often stored in large drums of 30, 55 or 83 gallon capacity, with one or more drums being placed onto a pallet for easy movement by a forklift or hand truck apparatus. Because there is a high likelihood of leakage or spillage of the liquid, containment pallets have been developed which retain any liquid spillage in a large volume sump area. Regulations promulgated by the Environmental Protection Agency require the sump area to retain 100% of the volume of the single largest storage drum to be supported on the pallet, while the Uniform Fire Code requires a minimum sump area volume of 66 gallons. The containment pallets generally consist of four vertical walls and a solid bottom, with some sort of support means to elevate the drums above the sump area. This support means usually takes the form of raised ridges or column members extending upward from the bottom of the sump area or means to support a separate perforated deck or platform above the sump area, either with centrally located support columns or a peripheral support shoulder incorporated on the inside of the walls. An example of a containment pallet is shown in U.S. Pat. No. 4,930,632 to Eckert et al.

Because the storage drums can be very heavy when filled, and because they are often stored in multiples of two or four drums on a single pallet, it is difficult to design a pallet with sufficient strength which has the necessary sump capacity, especially when taking into consideration that the optimum design will have low side walls and a low deck height to make loading and unloading the drums safer and easier. To maximize the volume of the sump area it is desirable to reduce the number of internal support members for the deck, meaning that a peripheral support for the deck is the preferred construction. In those containment pallets having a deck supported on a peripheral shoulder or lip located near the top of the side walls however, the compressive forces tend to push outwardly against the side walls, causing the walls to bow outward and eventually leading to failure of the pallet wall structure. This deflection problem was addressed in U.S. Pat. No. 5,359,955 to Grebenyuk by providing internal supports which extended from the midpoint of each side wall, creating a T-shape in horizontal cross-section. The supports extended from the bottom of the sump area to the top, the supports creating a surface onto which the deck is placed. The problem with this solution is that the supports themselves occupy a large area of the sump area, which means that the side wall height must be increased to compensate for this lost containment volume.

It is an object of this invention to provide an improved containment pallet structure for containment pallets utilizing a peripheral shoulder to support the deck above the large volume sump area, the improvement being the addition of cross members linking opposite side walls, the cross members being relatively thin in cross-section and positioned above the sump area so as not to reduce the volume of the sump area. Any outward movement of the side walls is resisted by the cross members that connect the two opposing walls.

SUMMARY OF THE INVENTION

The invention generally comprises an improved structure for a containment pallet used to support one or more large drums of liquid material, the pallet being of the type having a large volume sump area formed by the combination of four generally vertical side walls and a solid bottom, the bottom being configured to allow insertion of the lifting prongs of a forklift or hand truck for movement of the pallet, and a perforated deck to receive the drums, the deck being supported above the sump area by deck support means, typically a peripheral shoulder or lip, either continuous or segmented, which extends inwardly from the side walls, along with possible support columns in the center of the pallet. The improvement resides in the addition to the deck support means of one or more cross members extending across and above the sump area from one side wall to the opposite side wall, preferably centrally located, the cross members acting along with the support shoulders to support the deck above the sump area, any outward deflection of the side walls being countered by the cross members linking the opposing walls. The cross members are preferably thin in cross-section and of limited surface area relative to the entire pallet so as not to interfere with the overall capacity of the sump area or the flow of liquid into the sump area. In the preferred form, a single cross member in the shape of a cross connects all four walls. The presence of the cross members allows greater weights to be loaded onto the containment pallet without the need to increase the thickness of the side walls.

BRIEF DESCRIPTION OF THE DRAWINGS

FIG. 1 is a perspective view of the invention in the preferred embodiment.

FIG. 2 is a top view of the invention in the preferred embodiment.

FIG. 3 is a cross-sectional view taken along line III—III of FIG. 2, also showing a deck member in elevated view.

FIG. 4 is a top view of an alternative embodiment.

FIG. 5 is a cross-sectional view taken along line V—V of FIG. 2, also showing a deck member in elevated view.

DETAILED DESCRIPTION OF THE INVENTION

With reference to the drawings, the invention will now be described in detail with regard to the best mode and preferred embodiment. In general, as seen in FIGS. 1 and 2, the invention comprises a new and improved construction for a containment pallet, a containment pallet being defined as a moveable platform for support of one or more large liquid container drums, typically sized to hold 30 or 55 gallons of liquid, the pallet being designed to collect and retain any liquid leaking from or spilled from the drums. In general, the containment pallet comprises a solid bottom 22 and side walls 21, the combination of which forms a large volume retention or sump area 27. Legs 23, either attached or formed as a part of bottom 22, provide access space for insertion of the lifting prongs of a forklift or hand truck. Preferably legs 23 are hollow and open into the sump area 27 to increase the liquid retention capacity. An apertured, flat deck 24 directly supports the drums and is maintained above the sump area 27 in general by deck support means 25. The side walls 21 are constructed to extend above the deck 24 to provide a retention lip 28 to contain spillage or leakage within the interior of the containment pallet.

Because the drums used for storage of liquids are of large volume, the volume of the sump area 27 must be correspondingly large. To contain the full volume of a single drum, the sump area 27 must be able to retain at least 30 gallons to meet EPA regulations. Thus, for a 30 gallon drum, the sump area 27 volume must exceed 30 gallons and for a 55 gallon drum the sump area 27 volume must exceed 55 gallons. In practice however, the Uniform Fire Code regulations requiring a minimum 66 gallon capacity must be met, so the sump area 27 must exceed this volume. In addition, most containment pallets are designed to hold at least two and usually four drums per pallet. To create the large volume sump area 27, the side walls 21 must be heightened in comparison to standard non-containment pallets and the deck 24 must be maintained a sufficient distance above the bottom 22 so that the deck 24 and the drums themselves do not reduce the containment volume of sump area 27. The deck 24 is preferably supported around its outer perimeter by peripheral deck support means 25 extending inwardly from the side walls 21, such as a continuous or segmented shoulder 29, whereby the deck support means 25 likewise do not reduce the capacity of the sump area 27. Multiple drums filled with liquid are very heavy and the pressure of the deck 24 against the peripheral deck support means 25 causes the side walls 21 to bend outward. Provision of deck support means 25 in the interior of the pallet, such as columns or rails, will increase the strength of the pallet and somewhat reduce the pressure on the side walls 21, but their presence reduces the volume of the sump area 27 and must therefore be kept to a minimum, with the preferred design omitting any central deck support means 25 entirely.

In order to reduce the outward pressure against side walls 21 while retaining the peripheral deck support means 25 as the primary method of supporting the deck 24 above the sump area 27, one or more cross members 26 are provided connecting the upper portions of opposing side walls 21 along the interior portions. The cross members 26 are preferably constructed as a part of the deck support means 25, such that the deck 24 rests directly on the cross members 26, and can be extensions of portions of peripheral shoulders 29, as seen in FIGS. 2 and 3. Alternatively, the cross members 26 can be positioned adjacent or slightly below shoulders 29, as long as they do not excessively impend into the sump area 27. A cross member 26 is preferably relatively thin in cross-section, as shown in FIGS. 3 and 5, although other cross-sectional configurations such as rods, tubes, square beams, wires, etc., are possible if added structural integrity is required, and preferably extends from a generally central point on each side wall 21. The cross members 26 should be mounted to the side walls 21 as high as is practicable to provide maximum resistance to outward bending and to allow for the necessary volume of the sump area 27.

The preferred configuration for cross members 26 in a containment pallet is that of a cross, such that the cross member 26 extending between one set of opposing walls 21 intersects with the cross member 26 extending between the other set of opposing walls 21 at the center, as shown in FIGS. 1 and 2. The cross members 26 forming this cross shape will equally restrain all four side walls 21 when the deck 24 is loaded with drums, and the drums weight of the drums will be evenly distributed on the cross members 26. In effect, each side wall 21 acts to reinforce its opposite side wall 21 because of the cross members 26. Other configurations for cross members 26, such as shown in FIG. 4, are also possible.

The preferred material for construction of these containment pallets is a chemically resistant polymer such as polyethylene or the like. It is preferred that the pallets be constructed as an integral unit, with the deck 24 being constructed as a separate component. It is also possible to construct the cross members 26 of separate material, for example metal bands or wire, and mechanically or adhesively fasten them to the side walls 21. Typical dimensions for a containment pallet capable of holding four 55 gallon drums, with a sump area 27 exceeding 66 gallons, is approximately 53 inches square by 12 inches in height. The peripheral shoulder 29 extends approximately 2½ inches from the side walls 21. Cross members 26 are approximately 8 inches wide and 3/16 inches thick. The use of the cross members 26 allows the thickness of the side walls 21 to be kept to a minimum, typically approximately 3/16 to ¼ inches. Tests results show that the addition of cross members 26 to a containment pallet increases the load capacity for a uniformly distributed load from approximately 4000 pounds to 6000 pounds.

It is understood that substitutions and equivalents may be obvious to those skilled in the are, and the above examples are by way of illustration only. The full scope and definition of the invention therefore is to be as set forth in the following claims.

We claim:

1. A containment pallet comprising in combination four side walls and a bottom, deck means to support one or more drums, said deck means having an outer perimeter, peripheral deck support means extending inwardly from said side walls to support said outer perimeter of said deck means, a sump area defined by the interior area above said bottom, between said side walls and below the level of the peripheral deck support means, where said deck support means support said deck means above said sump area and do not extend into said sump area or from said bottom, and one or more cross members extending from said peripheral deck support means and connecting each of said side walls to another of said side walls, where said cross members are thin in cross-section and do not extend into said sump area.

2. The pallet of claim 1, where said one or more cross members intersect.

3. The pallet of claim 1, where said one or more cross members have limited surface area.

4. The pallet of claim 1, where said peripheral deck support means comprises a peripheral shoulder extending from said side walls.

5. The pallet of claim 4, where said peripheral shoulder is continuous.

6. The pallet of claim 1, where said side walls are composed of single layer material.

7. In a containment pallet having a deck means with an outer perimeter to support large drums, a large volume sump area for retention of liquids formed by the interior area defined by combination of two opposing sets of side walls, a bottom, and peripheral deck support means extending inwardly from said side walls to support said deck means above said sump area, and no interior deck support means extending from said bottom or extending into said sump area, the improvement comprising one or more thin in cross-section cross members extending from said peripheral deck support means and connecting each opposing set of side walls, where said cross members do not extend into said sump area.

8. The pallet of claim 7, where said one or more cross members intersect.

9. The pallet of claim 7, where said one or more cross members have limited surface area.

10. The pallet of claim 7, where said cross members are attached to said peripheral deck support means.

11. The pallet of claim 7, where said peripheral deck support means comprises a peripheral shoulder extending from said side walls.

12. The pallet of claim 11, where said peripheral shoulder is continuous.

13. The pallet of claim 7, where said side walls are composed of single layer material.

* * * * *